US007650705B2

(12) United States Patent
Donnadieu et al.

(10) Patent No.: US 7,650,705 B2
(45) Date of Patent: Jan. 26, 2010

(54) FOOTWEAR WITH AN UPPER HAVING AT LEAST ONE GLUED ELEMENT

(75) Inventors: Thierry Donnadieu, Sillingy (FR); Jean-Michel Challe, Rumilly (FR)

(73) Assignee: Salomon S.A.S., Metz-Tessy (FR)

( * ) Notice: Subject to any disclaimer, the term of this patent is extended or adjusted under 35 U.S.C. 154(b) by 302 days.

(21) Appl. No.: 11/044,009

(22) Filed: Jan. 28, 2005

(65) Prior Publication Data

US 2005/0166426 A1 Aug. 4, 2005

(30) Foreign Application Priority Data

Jan. 30, 2004 (FR) ..... 04 00904
Jul. 26, 2004 (FR) ..... 04 08248

(51) Int. Cl.
*A43B 5/04* (2006.01)

(52) U.S. Cl. ..... 36/50.5; 36/50.1; 36/45; 36/72 R

(58) Field of Classification Search ..... 36/50.1, 36/50.5, 72 R, 133, 45, 54
See application file for complete search history.

(56) References Cited

U.S. PATENT DOCUMENTS 2,842,872 A * 7/1958 Shultz ..... 36/72 R
3,310,889 A * 3/1967 Samuels ..... 36/72 R
3,597,862 A * 8/1971 Vogel ..... 36/117.1
3,650,051 A * 3/1972 Sass ..... 36/133
4,534,123 A * 8/1985 Salomon et al. ..... 36/99
4,642,913 A 2/1987 Hase
4,856,207 A * 8/1989 Datson ..... 36/2 R
4,899,466 A 2/1990 Skaja
5,020,247 A * 6/1991 Barret et al. ..... 36/50.5
5,167,084 A * 12/1992 Flammier ..... 36/117.2
5,189,818 A 3/1993 Skaja
5,214,863 A 6/1993 Skaja
5,435,080 A * 7/1995 Meiselman ..... 36/117.1
5,566,474 A * 10/1996 Leick et al. ..... 36/50.1
5,649,375 A * 7/1997 Zorzi ..... 36/117.1
5,875,566 A * 3/1999 Bourdeau et al. ..... 36/12
5,906,057 A 5/1999 Borsoi
5,934,599 A 8/1999 Hammerslag
5,974,698 A * 11/1999 Nash et al. ..... 36/87
6,029,376 A 2/2000 Cass
6,202,953 B1 3/2001 Hammerslag
6,264,214 B1 * 7/2001 Bonaventure et al. .. 280/11.221
6,289,558 B1 9/2001 Hammerslag
6,505,424 B2 * 1/2003 Oorei et al. ..... 36/129
6,860,035 B2 * 3/2005 Girard ..... 36/50.1
7,086,181 B2 * 8/2006 Farys ..... 36/50.5
2002/0095750 A1 7/2002 Hammerslag
2003/0204938 A1 11/2003 Hammerslag
2004/0250452 A1 * 12/2004 Farys ..... 36/89

FOREIGN PATENT DOCUMENTS

DE 433 711 C 9/1926
DE 19534092 A1 3/1997
DE 19630603 A1 2/1998
EP 0 376 940 B1 7/1990
EP 1 310 182 A1 2/2003
GB 910 409 A 11/1962
GB 1 000 048 A 8/1965

* cited by examiner

*Primary Examiner*—Marie Patterson
(74) *Attorney, Agent, or Firm*—Greenblum & Bernstein P.L.C.

(57) ABSTRACT

An article of footwear having a sole and an upper, the upper having at least two elements that are assembled to one another at a gluing zone, one of the elements being a protective flap or a tightening mechanism.

39 Claims, 6 Drawing Sheets

FOOTWEAR WITH AN UPPER HAVING AT LEAST ONE GLUED ELEMENT

CROSS-REFERENCE TO RELATED APPLICATIONS

The disclosure of this application is related to French Patent Application No. 04.00904, filed Jan. 30, 2004, the disclosure of which is hereby incorporated by reference thereto in its entirety and the priority of which is hereby claimed under 35 U.S.C. §119.

In addition, the disclosure of this application is also related to French Patent Application No. 04.08248, filed Jul. 26, 2004, the disclosure of which is hereby incorporated by reference thereto in its entirety and the priority of which is hereby claimed under 35 U.S.C. §119.

BACKGROUND OF THE INVENTION

1. Field of the Invention

The invention relates to the field of footwear, such as shoes and boots, and, more particularly, the field of sports footwear.

2. Description of Background and Relevant Information

A typical article of sports footwear includes a sole, which can be either flexible or rigid, and an upper for covering the wearer's foot mounted thereon. The upper is typically constructed in the form of a plurality of elements that are cut out and assembled to one another so as to form a three-dimensional envelope that is as close to the shape of the foot as possible. Generally, the shapes of these elements and their constituent materials are dictated by the position of the elements in the shoe or boot, and by the function they are adapted to perform. The upper can also have additional elements attached, such as a front end reinforcement, which are generally made of thick leather or rubber.

The upper of most articles of sports footwear includes medial and lateral quarters that are adapted to be brought toward one another by a tightening mechanism, generally in the form of lace. The quarters are separated by a longitudinal slit beneath which a comfort tongue extends.

In certain types of footwear, such as cross-country ski boots and certain hiking shoes and boots, the upper includes a protective flap that covers the tightening mechanism/lace, but which can be moved aside to enable lacing and unlacing, to facilitate putting the shoe on and taking the shoe off. Such protective flap is particularly useful for articles of footwear that are adapted to be worn in snow, as it prevents the snow from infiltrating into the footwear in the area of the slit that separates the medial and lateral quarters of the upper.

In a conventional design, the various constituent elements of an upper are essentially assembled by sewing/stitching. To this end, the elements to be assembled have overlapping portions by which two adjacent elements are superimposed. A through-seam, that is, a seam that is visible on both sides of the stitched superimposed portions, connects the two elements to one another. With a through-seam, the sewing thread is exposed on both surfaces and, therefore, on the outer surface of the upper, in particular. It is thus exposed to external attacks, in particular to friction that can wear out the thread and, therefore, cause the seam to rupture. Similarly, through-seams constitute points of entry for moisture to infiltrate into the footwear.

SUMMARY OF THE INVENTION

An object of the invention is to provide a new construction for the assembly of certain elements of an upper of an article of footwear.

To this end, a particular object of the invention is to increase the resistance to wear and/or the resistance to moisture penetration.

Another object of the invention is to provide a new aesthetic appearance for an article of footwear.

More particularly, an object of the invention is to provide an article of footwear, having an upper and a sole, in which at least two elements of the upper are assembled to one another at least partially in an adhesive or gluing zone.

In a first particular application according to the invention, an article of footwear includes a protective flap, adapted to cover a lace or tightening mechanism, in which the protective flap is assembled by an adhesive or glue.

The adhesion or gluing of the two elements of the upper can be undertaken in a recessed or depressed zone, where one of the two elements of the upper has a recess or a depression in the form of a thinner zone, for example.

In a second particular application according to the invention, the upper of the article of footwear has a closure or tightening mechanism assembled on the upper at least partially by adhesive or glue.

In the case in which the closure or tightening mechanism is of the lacing type that includes a series of lacing guides distributed on both sides of a foot insertion opening of the upper, at least one or more of the lacing guides are fixed on the upper at least partially by an adhesive or glue. Such guides can take the form of, or be regarded as, eyelets, keepers, returns, or other structures that allow the lacing to be guided in an appropriate path in the lacing zone for tightening the upper of the article of footwear, such guides being arrayed, for example, along the edges of each side or quarter of the longitudinal opening of the upper.

According to a first feature, each such lacing guide is assembled individually to the upper by stitches and/or glue or adhesive, and a covering band is assembled by glue or adhesive on the set of lacing guides located along each of the edges of the lacing zone. In this way, one ensures that there are no seams susceptible to abrasion or other attacks on the outer surface of the upper, in a zone that is particularly subject to such attacks. The article of footwear is therefore much more resistant to wear and tear. The article of footwear is further provided with a very particular appearance, with no visible seams and, therefore, it has a very sleek, stripped down appearance that is very aesthetic. If the constituent materials of the article of footwear are impermeable, an impervious construction is also obtained.

According to a second feature, each such lacing guide has two portions, a first portion having a base provided with a hole, the base being assembled to the upper by glue or adhesive, as well as a second portion inserted through the hole of the first portion. This construction enables an easier assembly of shaped or molded lacing guides. It also makes it possible to optimize the lacing guide, depending upon the materials selected for each of its portions.

In this case, the base of the first portion of the guide, for example, can be made of a synthetic material and assembled by welding to the material of the upper. Therefore, the base can be fixed to the upper without adding any additional material.

BRIEF DESCRIPTION OF DRAWINGS

Other characteristics and advantages of the invention will become apparent upon reading the following detailed description, with reference to the attached drawings, in which.

DETAILED DESCRIPTION OF THE INVENTION

In the embodiments and alternative embodiments specifically shown, an article of sports footwear 10, 110 is shown that essentially includes a sole 12, 112 on which an upper 14, 114 is mounted using any known technique. The upper 14, 114 can thus be mounted on the sole by gluing, stitching, co-molding, or other method of assembly.

The upper of such article of footwear can extend above, at, or below the ankle of the wearer and can be referred to as a shoe or a boot.

The upper 14, 114 according to the invention is generally a flexible upper, that is, an upper formed of primary elements made of flexible or relatively flexible materials, such as fabrics, coated fabrics, leather, and/or synthetic materials used in thin layers such as films, etc. However, the upper can have complementary elements that are relatively rigid in order to ensure the shaping of the upper and, for example, good foot retention, such as rigid or semi-rigid stiffeners, end pieces, protective or decorative elements, or local reinforcements.

Furthermore, the use of materials that are essentially flexible does not prevent their use in a thickness, or in a chemical form, such that they have some rigidity.

Unlike alpine ski boots, which are made of rigid materials, a flexible upper according to the invention adapts to the bending of the foot and/or to the rolling movement thereof during the sports activity in which it is used. Accordingly, the upper might typically have a flexion crease at the rear of the instep, demarcating an area at which the portion of the shoe adapted to cover the lower leg could flex relative to the portion of the shoe adapted to cover the foot.

According to the invention, the upper 14, 114 is externally formed of a plurality of elements, that is, at least two elements. At least two such elements are assembled at a glue zone or adhesive zone.

Gluing, in the context of this disclosure, including variations of the word "gluing" and "glue," refers to the assembly of two elements with an adhesive material or a glue inserted between the two elements, as well as such assembly by welding, whereby the two materials are directly assembled to one another through local application of heat or by means of vibration, such as high frequency or ultrasonic welding, for example. In the first case, the material to be used can be a liquid or paste, cement, or a thermofusible strip. In the second case, sometimes referred to as weld bonding, there is no addition of material between the two elements to be assembled, such as no addition of an adhesive material.

The gluing zone can be continuous for better mechanical strength, a more aesthetic appearance, and a greater imperviousness, particularly to the infiltration of moisture and water, etc.

Figure 1:
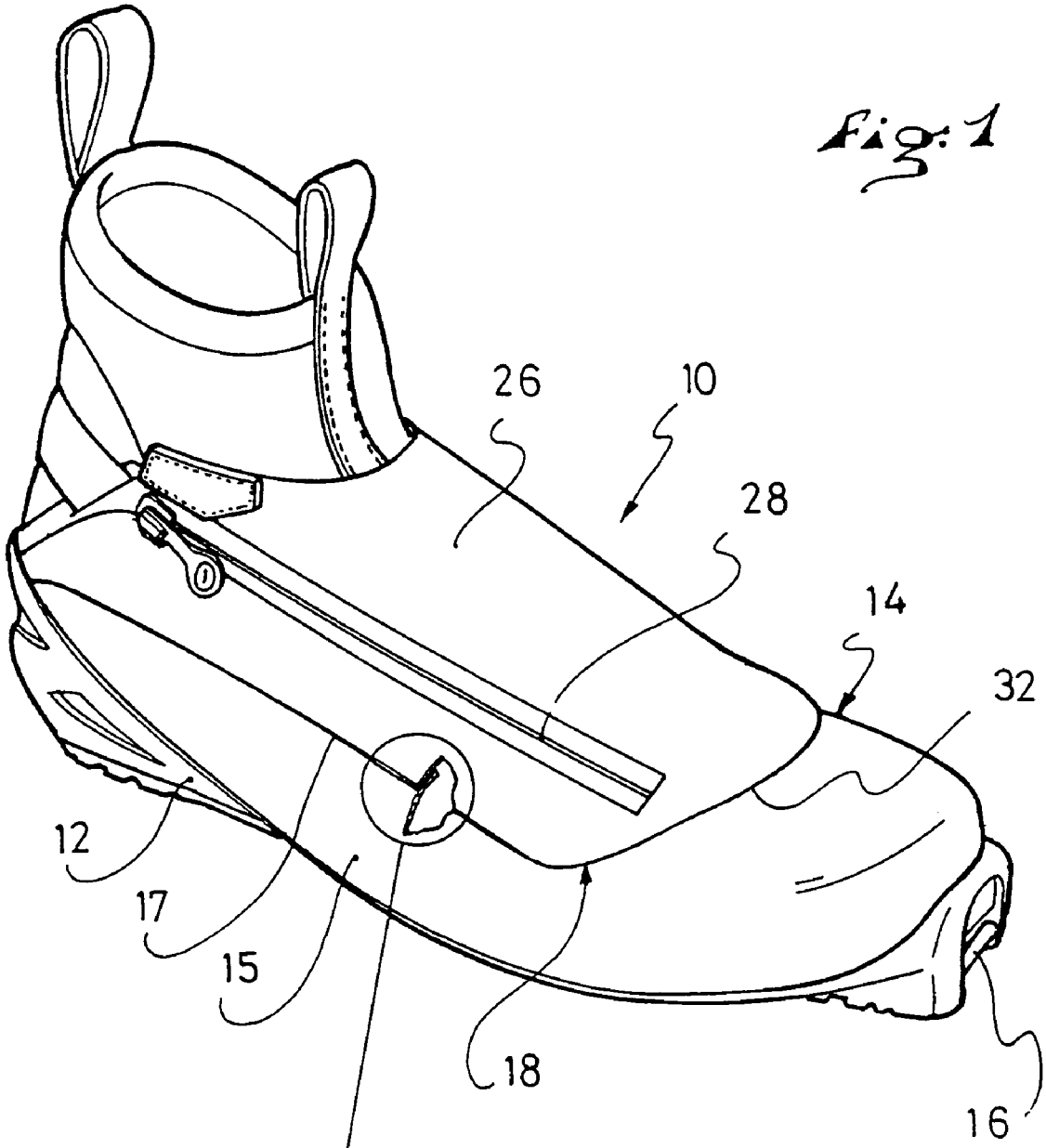
FIG. 1 is a schematic perspective view, partially broken-away, of a first embodiment of an article of sports footwear according to the teachings of the invention, the footwear having a protective flap.
Figure 2:
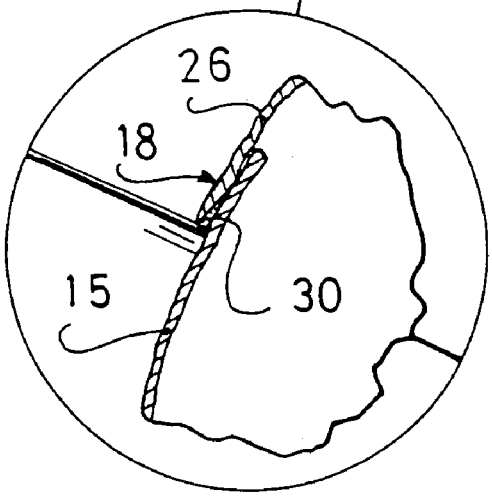
FIG. 2 is an enlarged view of the portion broken-away in FIG. 1, showing the adhesive/gluing zone in greater detail.
Figure 3:
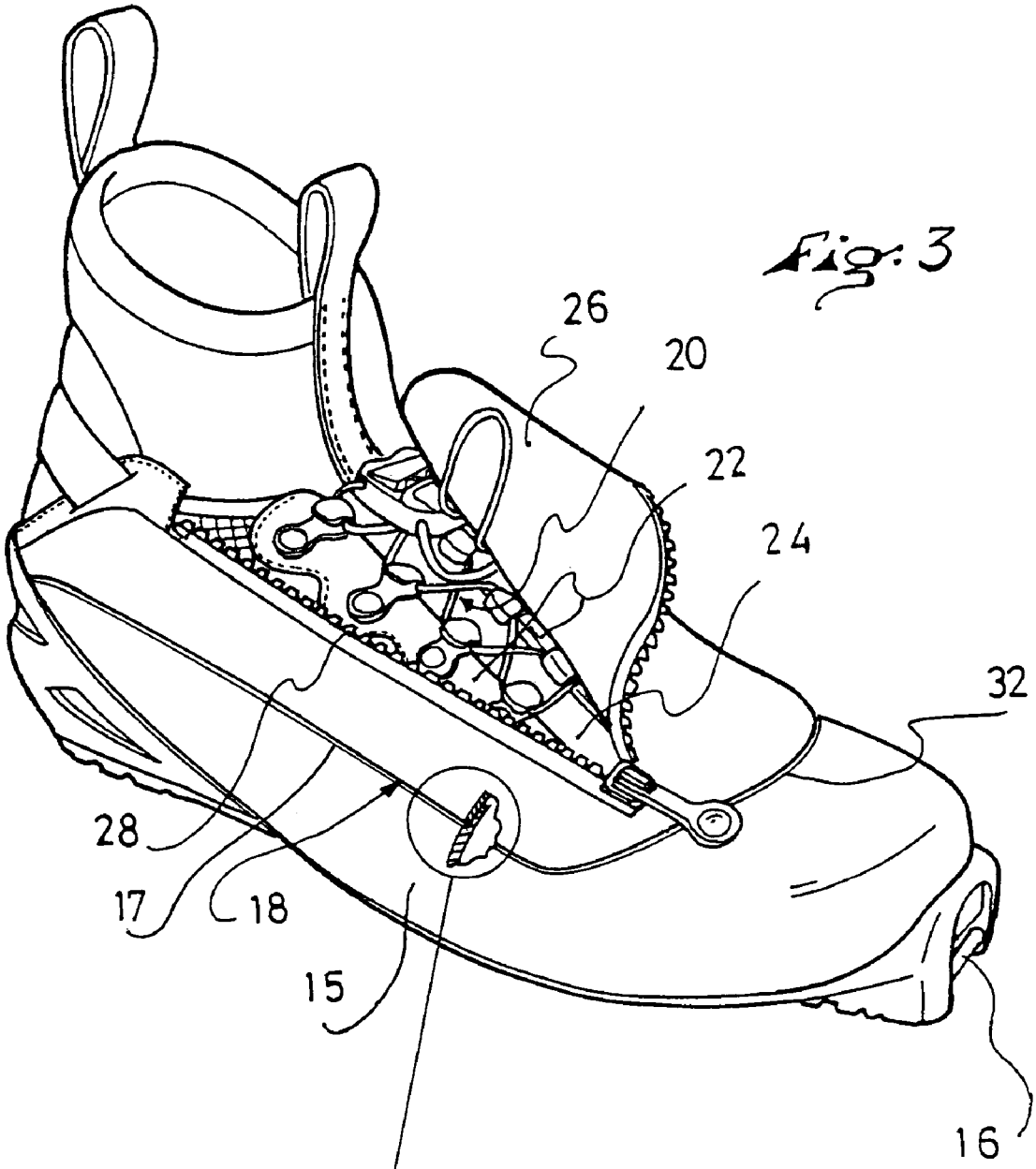
FIG. 3 is a view similar to that of FIG. 1, showing an alternative embodiment of the assembly of the protective flap (which is shown in an open position)

In the two examples shown in FIGS. 1-4, the article of sports footwear is a cross-country ski boot 10, the sole 12 of which has an attachment mechanism, shown in FIGS. 1 and 3 as a transversely extending rod or pin 16, adapted to cooperate with a cross-country ski binding. The variations of FIGS. 1 and 3 only differ in their respective embodiments of the glued assembly.

As can be seen in FIG. 3, the shoe upper shown has an outer vamp 15 that substantially covers the forefoot and extends rearward along the sole, substantially to the heel. Further, the shoe has a tightening mechanism, in this case a lacing tightening mechanism 20, adapted to bring closer together two quarters 22 of the upper that are separated by a longitudinal slit 24 extending in the zone of the instep. The lateral and medial quarters 22 of the upper can be made unitary with the vamp 15, or the quarters can be made as separate elements. In this first type of shoe, the upper 14 further has a protective flap 26 which, in an open position (shown in FIG. 3), allows access to the lacing mechanism, and, in a closed position (shown in FIG. 1), covers the tightening mechanism 20 and the longitudinal slit 24. As can be seen in both FIGS. 1 and 3, the upper has an uppermost edge that defines an opening for insertion and removal of the wearer's foot and the protective flap includes an uppermost extent that is positioned no higher than the uppermost edge of the upper and, in the illustrated embodiment, the uppermost extent of the protective flap extends lower than the uppermost edge of the upper.

The protective flap 26 comprises a piece of flexible material that covers the portion of the upper 14 adapted to be positioned above the upper portion of the foot, extending from the back of the toes up to the ankle. In the illustrated embodiment, the edges of the protective flap 26 are spaced above the lowermost extent of the upper. The flap 26 has two edges, that is, longitudinal lateral and medial edges 17, as well as a front edge 32, which are assembled to the vamp 15 with a glue or adhesive. The longitudinal edges 17 of the flap 26 extend along the sides of the shoe instep, and the front edge 32 of the flap extends substantially transversely through a zone corresponding to the shoe metatarsophalangeal bending zone. The rear edge of the flap 26 is free, and the flap 26 has a slide fastener, in the form of a zipper 28 in the illustrated embodiment, that runs to the rear edge and that demarcates, in the flap, two flap portions that are capable of separating from one another when the zipper 28 is open, in order to allow access to the lacing mechanism. The flap 26 can be made of a substantially impermeable material, such as, for example, a coated fabric sheet made of polyvinyl chloride (PVC).

According to the invention, the flap 26 is assembled to the vamp 15 at a gluing zone 18 which can extend continuously over the entire length of the edges of the flap, such as entirely along the longitudinal 17 and transverse 32 edges of the flap. The outer surfaces of the upper 14, such as the outer surface of the flap 26 and the outer surface of the vamp 15, as described elsewhere within this description, are to be regarded as outermost surfaces of the upper, which are subject to the aforementioned attacks and abrasion, as well as to the infiltration of moisture, during use of the footwear of the invention.

FIG. 2 schematically shows a detailed arrangement by which the adhesion, or gluing, can be constructed, that is, FIG. 2 shows a glue layer 30 spread along the gluing zone. In this case, the edge of the flap 26 and the vamp 15 are shown as overlapping one another in the gluing zone 18, the flap being arranged above the vamp. Furthermore, the edge of the flap 26 is trimmed, that is, it is cut to be beveled so that its thickness gradually decreases toward the edge. The lower surface of the flap 26 can thus be beveled. In this way, after assembly, one cannot, or almost cannot, observe any excessive thickness in the area constituting the limit between the flap and the vamp.

In this embodiment, the assembly can be carried out with a conventional glue. Such glue can be a polyurethane (PU)-based glue, for example, a dual-constituent glue that can be polymerized, of the type used for the upper/sole assembly. For example, such glue can be manually applied with a brush over the gluing zones, and the assembly is eventually carried out under pressure to ensure proper adhesion.

Figure 4:
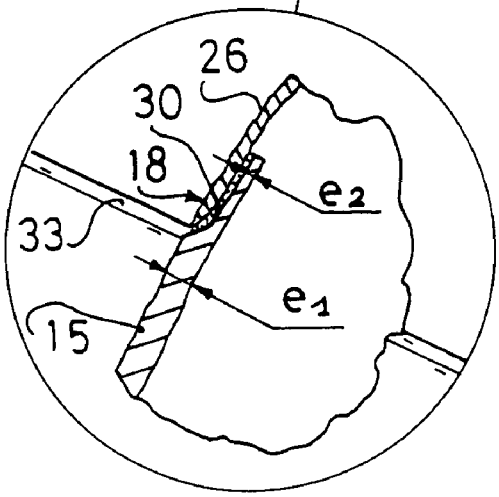
FIG. 4 is a view similar to that of FIG. 2, and is an enlarged view of the portion broken-away in FIG. 3, showing in more detail the alternative embodiment of the zone for gluing/adhering the flap onto the upper.

FIG. 4 shows an alternative embodiment in which at least one of the two elements assembled by gluing has, in the gluing zone 18, a recessed portion. The recessed portion can be a mere local deformation, a thinner zone, or a zone that has been subject to local compression in order to reduce its thickness, with the additional result of local densification of the material. Such compression can be generally obtained by methods combining pressure and heat, for example, high-frequency marking.

Thus, in the example shown in FIG. 4, the edge of the vamp 15 has a compressed area having a reduced thickness, which extends over the entire assembly zone 18. The upper surface of the vamp 15, therefore, has a depression marked by an edge 33, the depression corresponding to a zone having a thickness "e2" that is less than the thickness "e1" of the remainder of the vamp. The edge of the flap 26, whether beveled or non-beveled, therefore, overlaps this depressed edge of the vamp, still with the glue 30 inserted therebetween. As seen in FIG. 4, the depression of the vamp makes it possible to reduce the excessive thickness of the glued assembly, thereby enabling the edge of the flap to be almost flush in the area of the upper surface of the vamp, beyond the edge 33. One could provide each of the surfaces in contact with the two elements assembled by gluing to be depressed in their overlapping zone, which would further reduce any excessive thickness. Advantageously, the depression makes it possible to protect the side of the element that is on top in the overlapping (in this case the flap 26), thus limiting the risk of separation by tearing or stripping. Moreover, the edge 33 makes it possible to contain the glue in the case where the glue might otherwise flow outward when the assembly is pressurized to ensure the gluing, thereby limiting the unaesthetic appearance of any glue overflow. Furthermore, in the case where the glue would overflow beyond the overlapping zone, the edge 33 would force the glue to rise upon contact with the side of the flap 26, embedding this side in the glue. The side would then be reinforced by a slight excess of glue, thereby avoiding any risk of fraying the side.

Advantageously, the zipper 28 is also assembled to the flap 26 by gluing. To this end, a rectangular cutout is provided in the flap, which extends, for example, parallel to a longitudinal edge 17 of the flap, and which opens out in the rear edge of the flap. The zipper, which has two bands (each of which bears a series of teeth), is glued by the outer edges of the bands against the lower surface of the flap, along the edges of the window.

Because of this glued construction, the connection cannot be adversely affected by friction and other external attacks, which increases its useful life. This is particularly important for the connection zones that are located in the lower portion of the shoe, that is, the portion located beneath the user's ankle, and even more particularly in the metatarsophalangeal bending zone of the shoe and in the lacing zone of the shoe.

Such an assembly by gluing is completely impermeable, resisting moisture penetration into the shoe, such moisture coming from rain or snow.

The assembly by gluing is particularly advantageous for the junction of the elements of the upper that are arranged on the outside of the upper, and which are therefore visible, subject to direct contact with water, moisture, or snow, and subject to friction. Such an assembly is therefore particularly advantageous for a protective flap; but it can also be used for other elements of the upper, as disclosed in other embodiments, below. Indeed, the assembly by gluing eliminates the existence of apparent seams that are particularly susceptible to abrasion/friction or other attack, and therefore eliminates the risk of rupture of these seams. The assembly by gluing also provides a very particular aesthetic appearance due to the absence of any apparent seam.

In the embodiment shown, the materials of the two elements of the upper assembled to one another by gluing are identical and have the same thickness.

The invention also encompasses the gluing zone being completed by other assembly means for the assembly of the two elements considered. Indeed, it is known that the gluing techniques are very effective in terms of resistance to shearing stresses. Conversely, they can be less resistant to tearing or stripping stresses. If one of the portions of the connection zone of the two elements is particularly subject to such stresses, one can choose to replace or complete the assembly by gluing, in this zone, with another type of assembly, for example, stitching. In the example shown, one can provide the gluing zone to be reinforced by stitching in the area of the rear ends of the longitudinal edges 17 of the flap.

Figure 5:
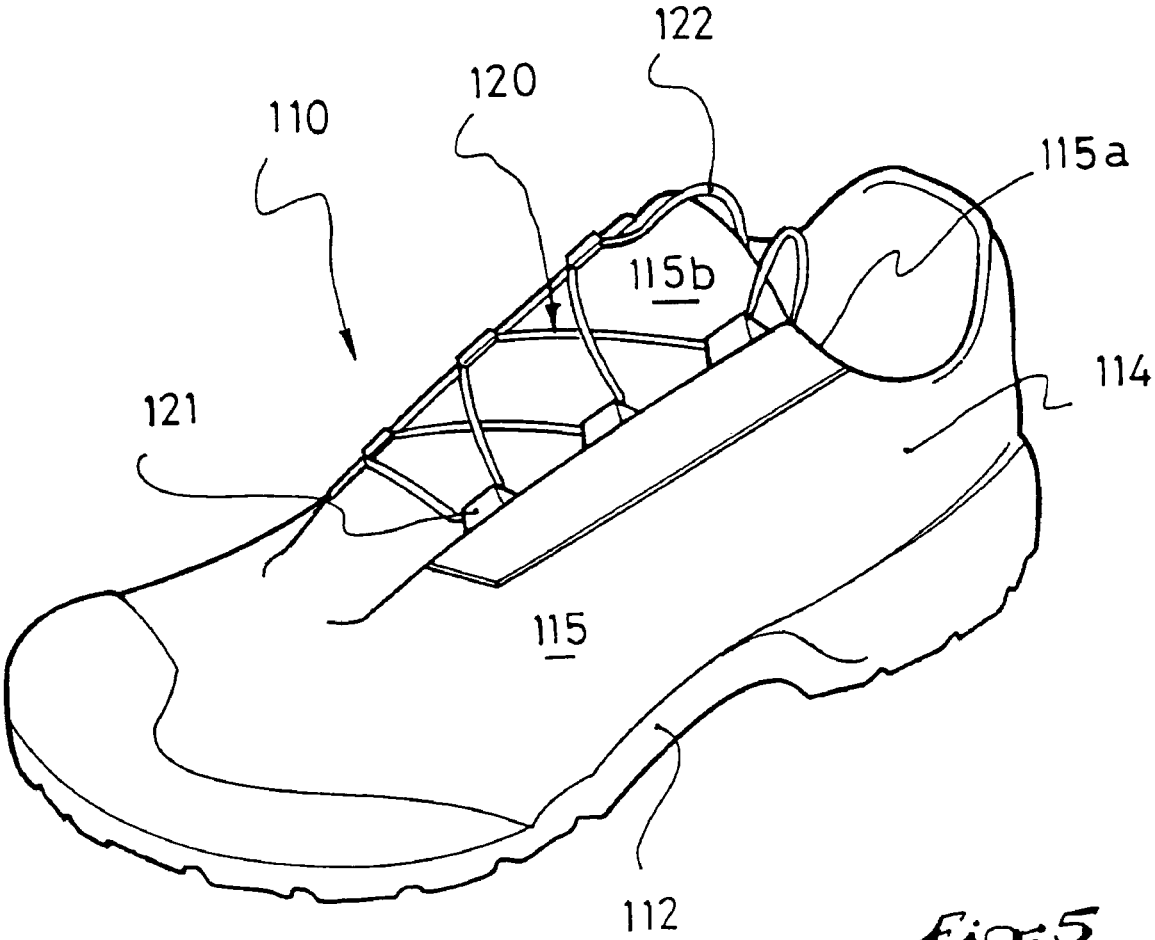
FIG. 5 is a schematic perspective front view of another embodiment of an article of footwear according to the invention.
Figure 6:
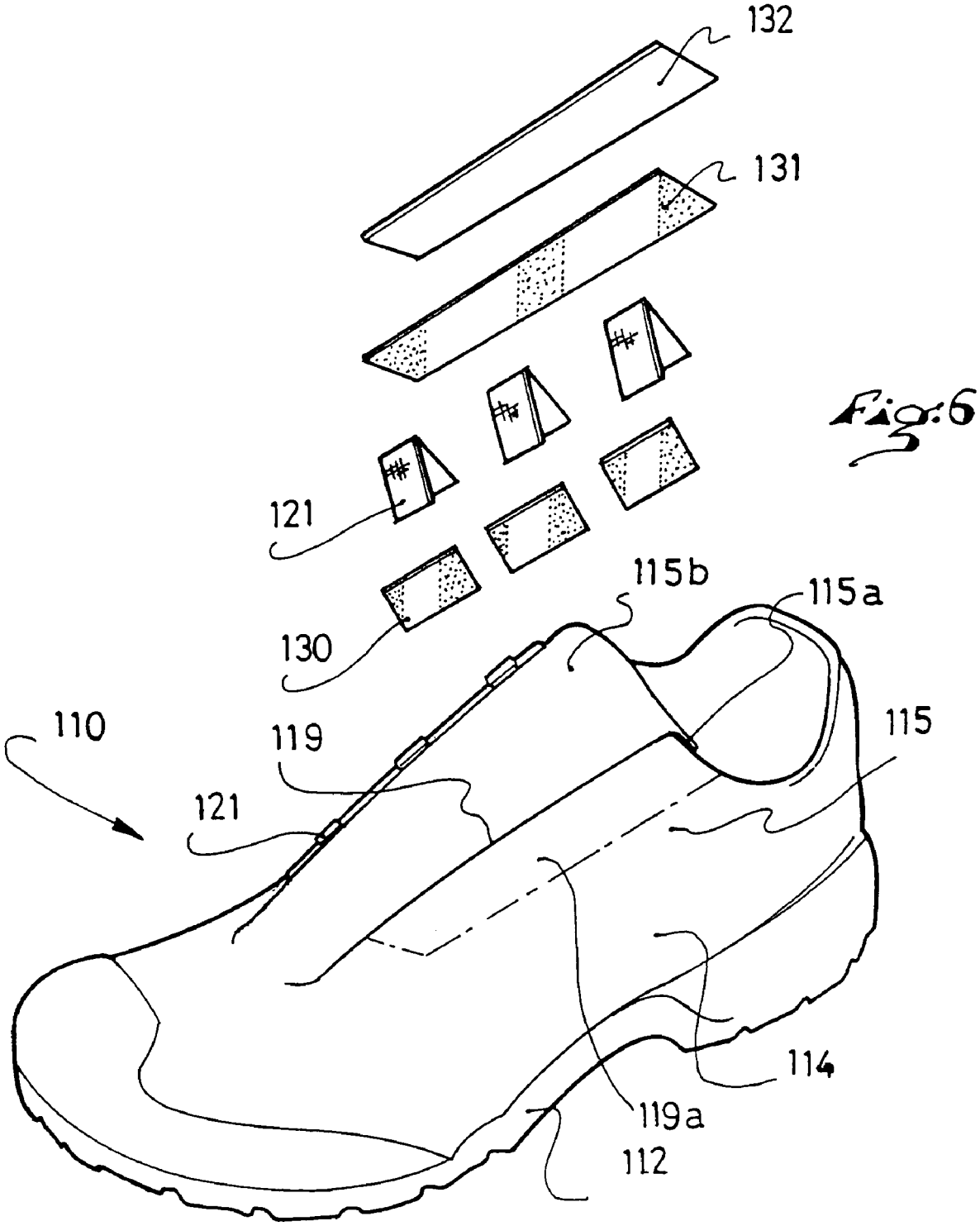
FIG. 6 is a view similar to FIG. 5, partially exploded to better show the manner of affixing lacing guides to the upper.
Figure 7:
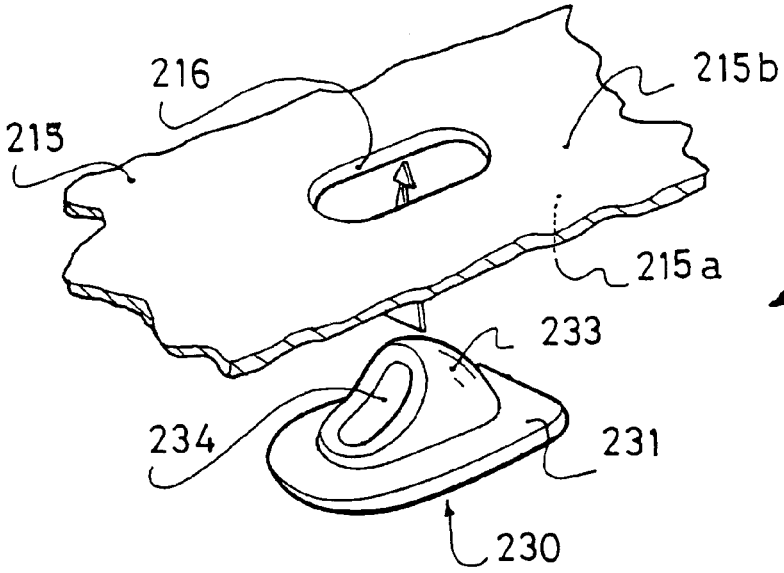
FIG. 7 is a detailed schematic view showing a first stage in the assembly of a lacing guide to the upper according to another embodiment.
Figure 8:
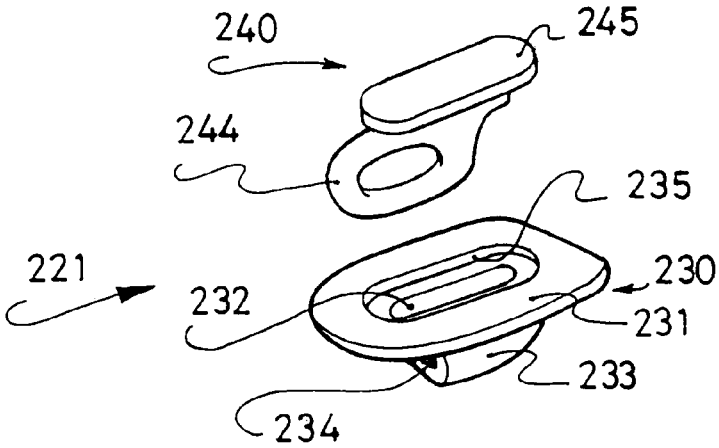
FIG. 8 is an exploded bottom view of a lacing guide prior to assembly.
Figure 9:
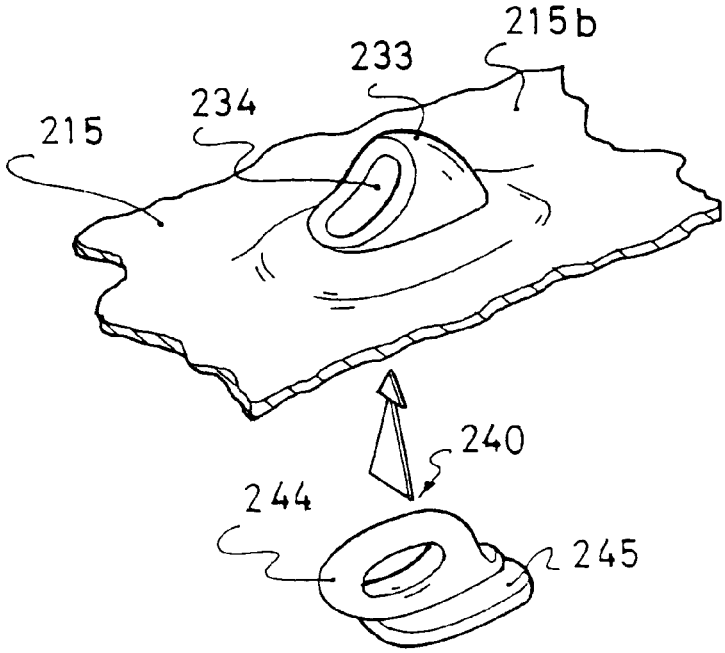
FIG. 9 is a view similar to FIG. 7, showing a second assembly stage.
Figure 10:
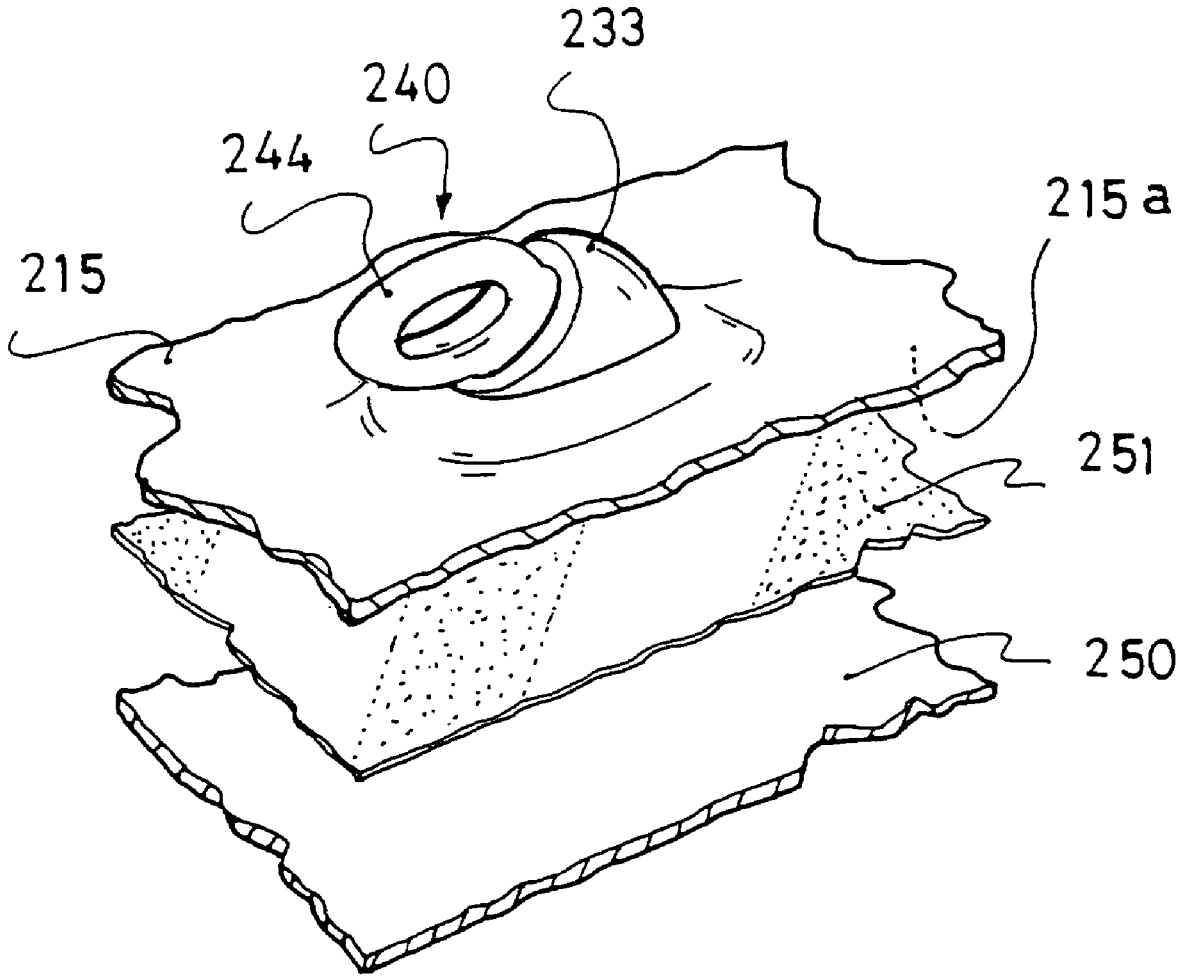
FIG. 10 is a view similar to FIGS. 7 and 9, showing a third assembly stage.

In the embodiment of FIGS. 5 and 6, the upper 114 of the shoe has an outer vamp 115 that substantially covers the user's forefoot, namely the instep and the toes, and extends rearward along the sole 112, substantially to the heel. The vamp 115 is in this case shown as a single element; it could also be made of two elements assembled to one another by gluing.

In the area of the instep zone, the vamp 115 defines a pair of gussets 115*a* on either side of a tongue 115*b* allowing for a wide opening of the upper for the insertion of the foot. As the case may be, the gussets l15*a* could be replaced by slits located between the tongue 115*b*and the associated edge of the vamp for a yet larger opening of the upper, or by gussets made of a thinner material.

The edges of the gussets 115*a* thus define a lacing zone 119 provided with a tightening mechanism, in this case a lacing tightening mechanism 120.

The lacing mechanism 120 comprises a series of lacing guides 121 facing one another along the edges 119*a* of the lacing zone 119, and a lace 122 that passes alternately via the lacing guides 121 facing one another so as to bring these edges closer together for tightening the shoe on the foot.

In the case shown, the lacing guides 121 are assembled on the upper by gluing. In this case, the lacing guides 121 are of the strap type, that is, they comprise a strap made of a synthetic textile material (such as polyester, polyamide, or polypropylene) or leather, folded over itself in a V-shape, as shown, or simply folded over itself without forming any angle, so as to form a lacing guide for the lace.

As the case may be, the lacing guides 121 can also be covered or internally reinforced by an insert made of a synthetic material, as described, for example, in the commonly owned U.S. Pat. No. 5,906,057, the disclosure of which is hereby incorporated by reference thereto in its entirety, so as to improve the sliding of the lace 122.

FIG. 6 shows certain elements of the shoe of FIG. 5, in an exploded view relative to the remainder of the shoe, for the purpose of facilitating a better understanding of how the lacing guides 121 are affixed to the upper 114.

Initially, each lacing guide 121 is individually glued on the vamp 115 by means of a first glue film 130 that can be, for example, a film of polyurethane glue sold under the trademark BEMIS® or DAEWOO®. This first gluing stage can alternatively be reinforced or replaced with stitches. The glue film can be made of another thermoplastic material, such as polyamide or polyester or other such material. The particular material is selected as a function of the material(s) of which the lacing guides 121 and the vamp are comprised. Next, a covering band 132 is also glued by means of a second glue film 131 over the set of lacing guides 121 and the vamp 115 of the upper 114 along the edges of the lacing zone 119.

The glue film 131 is of the same type as the first glue film, namely, a glue film of the polyurethane type, for example, sold under the trademark BEMIS® or DAEWOO®, or any other thermoplastic material. In the illustrated embodiment, the gluing is undertaken flat, prior to mounting and shaping the upper 114. The gluing temperature and pressure conditions depend upon the particular materials used for the vamp, the lacing guides and the glue film.

By way of example, the temperature can be between 150° C. and 225° C., and pressure can be approximately 1-10 bars for a glue film of the polyester type.

The covering band 132 makes it possible to complete the gluing and the assembly of the lacing guides 121 to the upper. Indeed, the lacing guides 121 are assembled to the upper between the two glue layers 130 and 131 and are therefore perfectly retained. It also makes it possible to guarantee complete imperviousness in the case where stitches are used in the area of the first assembly of the lacing guides 121 to the upper. It makes it possible to guarantee that there are no susceptible stitches that may be damaged by sources of external abrasion/friction applied in the lacing zone during use of the shoe.

Finally, the covering band 132 makes it possible to provide the lacing zone with a sleek and particularly attractive aesthetic appearance to the lacing zone, without any visible stitching, especially as the strap-shaped lacing guides used are particularly flat and discrete.

One obtains a lacing mechanism that is particularly aesthetic, surprisingly adequately strong, in spite of the substantial forces that typically are exerted on the gluing zone during tightening and use of the shoe.

The particular gluing method described above could be modified. Thus, the lacing guides 121 could first be assembled to the covering band 132 by gluing before the formed assembly of the covering band 132 and the lacing guides 121 are glued to the vamp 115.

Similarly, the lacing guides 121 could be assembled in a single bar, or band, of lacing guides prior to assembly on the upper, the lacing guides being assembled together onto the upper.

The lacing guides 121 could be configured by a different type of lacing guide, more particularly, lacing guides made of a synthetic material, individually and/or arranged in a bar or band.

FIGS. 7-10 illustrate other embodiments of the invention as applied to the lacing, with non-flat lacing guides 221.

The lacing guides 221 are made of two portions, namely, a first portion 230 and a second portion 240, the latter being described further below. The first portion 230 has a base 231 provided with an elliptic hole 232 and a half-sleeve 233 partially covering the hole 232 of the base and itself having an opening 234 located in a plane forming an angle of about 45° with the base 231.

On the side opposite the sleeve 233, the base 231 has a recess 235 around the hole 232 of the base.

As will be evident from the following description, the recess 235 is adapted to cooperate with a base 245 of the second portion 240 of the lacing guide 221, in the form of a hook or otherwise a part having a guide surface for the lace, the hook 240 further having a ring-shaped portion 244 adapted to project from the opening 234 of the first portion 230.

The first portion 230 of the lacing guide 221 can be made of a synthetic material such as PU or polyamide. It could also comprise any other material. It is passed through an associated hole 216 provided in the material of the vamp 215, such that its base 231 remains in contact with the lower surface 215*a* of the material of the vamp 215, and the half-sleeve 233 conversely projects from the outer side, that is, from the side of the upper surface 215*b* of the vamp 215.

The base 231 is then welded to the material of the vamp 215 by a high frequency welding operation, such operation being made possible, for example, by the (PU) material used for the base 231.

Depending upon the materials used for the first portion 230 of the lacing guide and/or of the vamp 215, the base 231 could be glued by other means, particularly after insertion of a glue film.

Once the first portion 230 of the lacing guide has been assembled to the vamp, the second portion 240 or hook is introduced in the hole 232 and the opening 234, its base 245 adjusting to the recess 235 of the base 231 of the first portion of the lacing guide.

A local reinforcement 250 is then applied and assembled by gluing, by means of a glue film 251, on the lower surface 215*a* of the vamp 215 so as to retain the hook 240 and, therefore, prevent the disassembly of the lacing guide 221.

The reinforcement 250 also serves to locally reinforce the assembly of the lacing guide to the vamp 215.

Here again, a very aesthetic, impervious, albeit very strong, assembly of the lacing guide to the vamp is obtained.

In the present case, the hook-shaped portion 240 can be made of a metallic material and, therefore, can be particularly resistant to wear and tear.

In the case shown, the lacing guide 221 is welded, glued to the upper without use of reinforcing stitches, and no cover is then positioned on the outer surface of the vamp. As the case may be, such a cover could be used for aesthetic reasons, such as having a lacing band as in the preceding example, hiding the holes 216, etc. The base 231 can be fixed to the vamp by stitching; in that case a glued covering band could be used to improve the aesthetic appearance and to make stitches more impervious.

As in the other embodiments described hereinabove, the connection of the lacing mechanism to the remainder of the upper is reinforced and protected from external attacks, and makes it possible to obtain a connection that is completely impervious and much less susceptible to abrasion and friction.

Finally, this assembly by gluing provides a particularly advantageous appearance and offers new possibilities with respect to the aesthetic appearance of the entire shoe.

The present invention is not limited to the particular embodiments that have been shown and described by way of non-limiting examples, but encompasses all similar and equivalent embodiments. In particular, the particular aspects of each of the embodiments described can be transposed to the other embodiments, with the associated advantages.

What is claimed is:

1. An article of footwear comprising:

an external sole;

an upper affixed to the sole, said upper comprising a medial quarter and a lateral quarter;

a tightening mechanism for tightening the quarters on a wearer's foot;

the upper comprising at least two elements assembled to one another at least partially along a gluing zone;

the upper having an uppermost edge defining an opening for insertion and removal of the wearer's foot;

at least one of said two elements comprising an outermost surface of the upper;

said one of said two elements including an edge spaced above a lowermost extent of the upper and extending upwardly along said upper from said edge, said gluing zone extending to said edge;

said one of said two elements having an uppermost extent not solely defining said uppermost edge of the upper;

a second of said two elements comprising a vamp;

said edge of said one of said two elements overlapping a second of said two elements at said gluing zone;

said edge being an edge of said outermost surface of the upper, said outermost surface of the upper being adapted to be exposed to sources of abrasion and moisture during use of the article of footwear.

2. An article of footwear according to claim 1, wherein:

the tightening mechanism comprises a lacing tightening mechanism assembled at least partially by being glued to the upper.

3. An article of footwear according to claim 2, wherein:

the lacing tightening mechanism comprises a plurality of lacing guides assembled to the upper with glue.

4. An article of footwear according to claim 3, wherein:

first and second pluralities of the lacing guides are assembled individually to the lateral and medial quarters, respectively.

5. An article of footwear according to claim 3, wherein:

each lacing guide comprises two portions, said two portions comprising a first portion having a base provided with a hole, the base being glued to the upper, and a second portion inserted through the hole of the first portion.

6. An article of footwear according to claim 5, wherein:

the first portion extends through an associated hole of the upper, the base of the first portion being glued against an undersurface of the upper.

7. An article of footwear according to claim 5, wherein:

the base of the first portion is made of a synthetic material and is assembled by having been welded to the material of the upper.

8. An article of footwear according to claim 5, wherein:

the base is assembled to the upper by being glued by means of a glue film inserted between the base of the first portion and the upper.

9. An article of footwear according to claim 5, wherein:

the second portion is made of a metallic material.

10. An article of footwear according to claim 5, wherein:

a reinforcement is applied to the lower surface of the lacing guide and to the upper.

11. An article of footwear according to claim 4, wherein:

each lacing guide is individually assembled to the upper with stitches and/or glue;

a covering band is assembled by glue on a set of lacing guides located along each of the edges of the lacing zone.

12. An article of footwear according to claim 11, wherein:

the glue comprises a thermoplastic glue film.

13. An article of footwear according to claim 11, wherein:

each lacing guide comprises a strap.

14. An article of footwear according to claim 5, wherein:

the lacing tightening mechanism is arranged in a zone exposed to sources of abrasion.

15. An article of footwear according to claim 1, wherein:

at least one of the two elements has a depression in the gluing zone.

16. An article of footwear according to claim 15, wherein:

the depression corresponds to a thinner zone of said element.

17. An article of footwear according to claim 1, wherein:

at least one of the two elements has a beveled thickness in the gluing zone, said thickness tapering toward an edge of said one of the two elements.

18. An article of footwear according to claim 1, wherein:

the upper extends above an ankle of a wearer when worn by the wearer.

19. An article of footwear according to claim 1, wherein:

said lateral and medial quarters are unitary with said vamp.

20. An article of footwear comprising:

an external sole;

an upper comprising:

an uppermost edge defining an opening for insertion and removal of a wearer's foot;

a medial quarter, a lateral quarter, and a longitudinal slit separating the medial and lateral quarters;

a tightening mechanism joining the medial and lateral quarters;

a protective flap positioned above the tightening mechanism and covering a forwardmost end of the longitudinal slit;

the protective flap having a lower edge extending continuously from a front edge, said lower edge having an extent spaced above an upper edge of the external sole;

the protective flap being assembled to and over an outer surface of at least one additional element of the upper by gluing in a gluing zone arranged on an outer surface of the upper exposed to abrasion and moisture, said outer surface of said one additional element being adapted to be exposed to sources of abrasion and moisture during use of the article of footwear;

the protective flap having an uppermost extent not solely defining said uppermost edge of the upper.

21. An article of footwear according to claim 20, wherein:

the protective flap and the additional element of the upper are made of a flexible material to allow flexing of the upper by the wearer.

22. An article of footwear according to claim 20, wherein:

the protective flap and the additional element of the upper are made of an impervious material.

23. An article of footwear according to claim 20, wherein:

said protective flap has a beveled thickness in the gluing zone, said thickness tapering toward an edge of said protective flap.

24. An article of footwear according to claim 20, wherein:
said protective flap extends upwardly along said upper from an edge of said protective flap spaced from a lowermost extent of the upper.

25. An article of footwear according to claim 20, wherein:
said protective flap has an edge overlapping said one additional element of the upper in a gluing zone, said edge being adapted to be exposed to sources of abrasion and moisture during use of the article of footwear.

26. An article of footwear according to claim 25, wherein:
said gluing zone extends to said edge.

27. An article of footwear according to claim 20, wherein:
at least said protective flap is made of a material to allow flexing at a flexion crease at a rear of an instep of the upper.

28. An article of footwear according to claim 20, wherein:
the protective flap and the additional element of the upper are assembled together by glue in a gluing zone; and
no stitched seam extends within said gluing zone.

29. An article of footwear according to claim 20, wherein:
the upper extends above an ankle of a wearer when worn by the wearer.

30. An article of footwear according to claim 20, wherein:
said one additional element of the upper is constituted by a vamp substantially covering a forefoot of the wearer.

31. An article of footwear according to claim 20, wherein:
said lateral and medial quarters are unitary with said one additional element.

32. An article of footwear comprising:
an external sole;
an upper assembly comprising:
a medial quarter and a lateral quarter;
a tightening mechanism joining the medial and lateral quarters;
a protective flap positioned to cover the tightening mechanism of the upper assembly, the protective flap having a lowermost edge, an extent of said lowermost edge being spaced above the external sole;
said protective flap further covering a portion of the upper assembly corresponding to an upper portion of a wearer's foot extending from a rear of the wearer's toes to the wearer's ankle;
said protective flap being assembled to the upper assembly by means of glue in a gluing zone between said protective flap and said upper assembly.

33. An article of footwear according to claim 32, wherein:
said protective flap covers an entirety of the tightening mechanism.

34. An article of footwear according to claim 32, wherein:
a longitudinal slit is positioned between said medial and lateral quarters;
said protective flap extends over said longitudinal slit and extends longitudinally to a forwardmost end of said longitudinal slit.

35. An article of footwear according to claim 32, wherein:
no stitched seam extends along an elongated extent of said gluing zone.

36. An article of footwear according to claim 32, wherein:
said upper assembly further comprises a vamp;
said protective flap is assembled to said vamp of said upper assembly.

37. An article of footwear according to claim 36, wherein:
said medial and lateral quarters are unitary with said vamp.

38. An article of footwear comprising:
an external sole;
an upper assembly comprising:
a medial quarter and a lateral quarter;
a tightening mechanism joining the medial and lateral quarters;
a protective flap positioned to cover the tightening mechanism of the upper assembly;
said protective flap further covering a portion of the upper assembly corresponding to an upper portion of a wearer's foot extending from a rear of the wearer's toes to the wearer's ankle;
said protective flap being assembled to the upper assembly by means of glue in a gluing zone between said protective flap and said upper assembly;
said protective flap is assembled to the upper assembly by means of glue, a non-glue region positioned between said glue and said external sole.

39. An article of footwear according to claim 38, wherein:
the protective flap has a lowermost edge, an extent of said lowermost edge being spaced above the external sole.

* * * * *